US010738969B2

(12) United States Patent
Li

(10) Patent No.: US 10,738,969 B2
(45) Date of Patent: Aug. 11, 2020

(54) LIGHT-EMITTING STRUCTURE AND LIGHT-EMITTING SYSTEM WITH THE SAME

(71) Applicant: SHENZHEN EWINLIGHT TECHNOLOGY CO., LTD., Shenzhen, Guangdong (CN)

(72) Inventor: Shihao Li, Guangdong (CN)

(73) Assignee: SHENZHEN EWINLIGHT TECHNOLOGY CO., LTD., Shenzhen (CN)

( * ) Notice: Subject to any disclaimer, the term of this patent is extended or adjusted under 35 U.S.C. 154(b) by 0 days.

(21) Appl. No.: 16/314,386

(22) PCT Filed: Jun. 29, 2016

(86) PCT No.: PCT/CN2016/087789
§ 371 (c)(1),
(2) Date: Dec. 28, 2018

(87) PCT Pub. No.: WO2018/000286
PCT Pub. Date: Jan. 4, 2018

(65) Prior Publication Data

US 2019/0154231 A1 May 23, 2019

(51) Int. Cl.
*F21V 5/04* (2006.01)
*F21V 7/04* (2006.01)
(Continued)

(52) U.S. Cl.
CPC ..... *F21V 5/045* (2013.01); *F21V 5/04* (2013.01); *F21V 7/0025* (2013.01);
(Continued)

(58) Field of Classification Search
CPC ... F21V 5/045; F21V 5/04; F21V 7/04; F21V 7/0091; F21V 7/0025; F21V 7/0033;
(Continued)

(56) References Cited

U.S. PATENT DOCUMENTS 4,929,866 A 5/1990 Murata et al.
5,461,547 A 10/1995 Ciupke et al.
(Continued)

FOREIGN PATENT DOCUMENTS

CN 1405489 A 3/2003
CN 1470799 A 1/2004
(Continued)

OTHER PUBLICATIONS

Machine Translation of CN102200257A.*
(Continued)

*Primary Examiner* — Joseph L Williams
*Assistant Examiner* — Jose M Diaz

(57) ABSTRACT

A light-emitting structure and a light-emitting system with the same are provided. The light-emitting structure includes a plurality of extension portions (10) and a plurality of light adjusting portions (20), and the plurality of extension portions (10) and the plurality of light adjusting portions (20) are sequentially alternately connected; the plurality of extension portions (10) controls the light-emitting range of the light-emitting structure, and the plurality of light adjusting portions (20) is disposed at a predetermined angle with respect to an incident light direction to control a light-emitting direction.

18 Claims, 8 Drawing Sheets

(51) Int. Cl.

| | |
|---|---|
| ***F21V 7/00*** | (2006.01) |
| ***F21V 13/04*** | (2006.01) |
| ***F21Y 105/18*** | (2016.01) |
| ***F21Y 103/00*** | (2016.01) |

(52) U.S. Cl.
CPC ..... *F21V 7/0091* (2013.01); *F21V 7/04* (2013.01); *F21V 13/04* (2013.01); *F21Y 2103/00* (2013.01); *F21Y 2105/18* (2016.08)

(58) Field of Classification Search
CPC ..... F21V 7/06; F21V 7/005; F21V 7/0041; F21V 7/043; F21V 13/04; F21Y 2103/00; F21Y 2103/10; F21Y 2105/18; F21Y 2105/16; F21Y 2115/30
See application file for complete search history.

(56) References Cited

U.S. PATENT DOCUMENTS

| | | | | |
|---|---|---|---|---|
| 5,575,549 | A * | 11/1996 | Ishikawa | G02B 6/0025 362/330 |
| 5,897,201 | A | 4/1999 | Simon | |
| 6,960,009 | B2 * | 11/2005 | Shinohara | G02B 6/0016 362/23.09 |
| 9,223,077 | B2 * | 12/2015 | Matsumoto | G02B 6/0036 |
| 9,329,328 | B2 * | 5/2016 | Chen | G02B 6/0053 |
| 10,436,970 | B2 * | 10/2019 | Durkee | G02B 6/0063 |
| 2001/0019479 | A1 | 9/2001 | Nakabayashi et al. | |
| 2006/0171159 | A1 | 8/2006 | Anderlini | |
| 2012/0147296 | A1 * | 6/2012 | Montgomery | G02F 1/133615 349/70 |
| 2015/0109820 | A1 * | 4/2015 | Wilcox | G02B 6/32 362/609 |
| 2017/0045745 | A1 * | 2/2017 | Piskunov | G02B 27/0176 |
| 2017/0178754 | A1 * | 6/2017 | Wunderlich | G01D 11/28 |

FOREIGN PATENT DOCUMENTS

| | | | |
|---|---|---|---|
| CN | 102081186 | A | 6/2011 |
| CN | 102200257 | A | 9/2011 |
| DE | 102012109149 | A1 | 3/2014 |
| EP | 1826475 | A1 | 8/2007 |
| JP | 2012238407 | A | 12/2012 |

OTHER PUBLICATIONS

International Search Report of PCT Patent Application No. PCT/CN2016/087789 dated Mar. 29, 2017.
Extended European Search Report of counterpart European Patent Application No. 16906687.5 dated Jan. 7, 2020.

* cited by examiner

LIGHT-EMITTING STRUCTURE AND LIGHT-EMITTING SYSTEM WITH THE SAME

TECHNICAL FIELD

The present application relates to the technical field of optical illumination, and in particular to a light-emitting structure and a light-emitting system with the same.

BACKGROUND

An existing directional light-emitting system is generally completed by a reflection cup or a TIR lens. A light-emitting source is placed near a focus of the reflection cup or the TIR lens. The light-emitting source generates a beam at a certain angle, and then the beam is emitted at a predetermined angle through reflection, total reflection, refraction, and the like by the reflection cup or the TIR lens, thereby achieving an effect of directional illumination. For example, spotlights and PAR lights and the like are lighting products that use the reflection cup or the TIR lens to achieve a directional illumination effect.

As shown in FIG. 1, a directional light-emitting system in the prior art utilizes a reflection cup 2 to guide an optical path, thereby achieving a directional light-emitting effect. A light-emitting source 1 is mounted inside the reflection cup 2, and then a reflecting surface is disposed on an inner surface of the reflection cup 2. When light emitted by the light-emitting source 1 illuminates the reflecting surface, the light is projected by the reflecting surface at a predetermined angle (a light-emitting direction as shown in FIG. 1 is a light-emitting direction parallel to a central axial line direction of the reflection cup 2), thereby achieving a design purpose of directional light emission.

However, the directional light-emitting system in the prior art has certain limitations during practical applications. Due to the light gathering characteristics of the reflection cup and the TIR lens, a light-emitting aperture c of the reflection cup and the TIR lens is generally proportional to its own optical height d, and its cross-sectional profile along the central axis of its overall shape approximates a parabola $y^2=2ax$. The shape design of the reflection cup and the TIR lens is relatively fixed, making it difficult to flexibly design and apply the ranges of light-emitting apertures of the reflection cup and the TIR lens as required.

SUMMARY

An objective of the present application is to provide a light-emitting structure and a light-emitting system with the same, aiming to solve the problem that the relatively fixed shape design of a reflection cup and a TIR lens in the prior art makes it difficult to flexibly design and apply the ranges of light-emitting apertures of the reflection cup and the TIR lens as required.

To solve the above technical problem, the technical solution of the present application is as follows: a light-emitting structure is provided, including a plurality of extension portions and a plurality of light adjusting portions, and the plurality of extension portions and the plurality of light adjusting portions are sequentially alternately connected; the plurality of extension portions controls the light-emitting range of the light-emitting structure, and the plurality of light adjusting portions is disposed at a predetermined angle with respect to an incident light direction to control a light-emitting direction.

Alternatively, in a horizontal extending direction, extension surfaces of the respective extension portions are planes which are arranged parallelly and spaced apart from each other, and the extension surface of each of the extension portions is disposed at a first predetermined angle with a light adjusting surface of the adjacent light adjusting portion.

Alternatively, in a horizontal extending direction, the extension surfaces of the respective extension portions are planes which are arranged parallelly, and the extension surfaces of the respective extension portions extend in the same horizontal plane; each of the light adjusting portions protrudes from the horizontal plane, and the extension surface of each of the extension portions is disposed at a second predetermined angle with the light adjusting surface of the adjacent light adjusting portion.

Alternatively, extension surfaces of the respective extension portions extend in the same reference plane, and the reference plane is disposed at an angle with the horizontal plane; each of the light adjusting portions protrudes from the reference plane, and the light adjusting surface of each of the light adjusting portions is disposed at a third predetermined angle with the horizontal plane.

Alternatively, the extension surface of each of the extension portions is a curved surface; each of the light adjusting portion protrudes from the adjacent extension surface, and the light adjusting surface of each of the light adjusting portions is disposed at a fourth predetermined angle with the horizontal plane.

Alternatively, the extension surface of each of the extension portions is a plane; the extension surfaces of the respective extension portions are sequentially disposed at gradually increased angles with the horizontal plane; each of the light adjusting portions protrudes from the adjacent extension surface, and the light adjusting surface of each of the light adjusting portions is disposed at a fifth predetermined angle with the horizontal plane.

According to another aspect of the present application, a light-emitting system is provided, including a light source portion and a light-emitting structure, where the light source portion includes a light-emitting source; the light-emitting structure is the above-mentioned light-emitting structure, and light emitted by the light-emitting source is directionally guided out by the light-emitting structure.

Alternatively, the light-emitting source is one of directional light sources of a laser light source, a LED laser light source, an optical fiber source, a spotlight light source, a PAR light source and an AR light source.

Alternatively, the light source portion also includes a reflection cup, and the light-emitting source is disposed in a notch of the reflection cup; the light emitted from the light-emitting source is emitted after it is reflected and converged by a reflecting surface of the reflection cup, and the emitted light illuminates light adjusting surfaces of the light adjusting portions of the light-emitting structure for directional light emission.

Alternatively, the reflection cup is one of a light-converging TIR lens, a convex lens or a Fresnel lens which has a light converging function.

Alternatively, the light source portion also includes a first reflective mirror; a reflective mirror surface of the first reflective mirror is disposed opposite to the reflecting surface of the reflection cup; and the light emitted out of the reflecting surface is reflected by the reflective mirror surface of the first reflective mirror to the light adjusting surface of the light adjusting portion.

Alternatively, the light source portion also includes a second reflective mirror; a reflective mirror surface of the second reflective mirror is disposed opposite to the reflective mirror surface of the first reflective mirror; and the light reflected from the first reflective mirror is reflected by the reflective mirror surface of the second reflective mirror reflect to the light adjusting surface of the light adjusting portion.

Alternatively, the number of the light source portions is plural, and the plurality of light source portions is arranged in a linear single row or a plurality of rows; the extension surface of each of the extension portions of the light-emitting structure and the light adjusting surface of each of the light adjusting portions are strip-shaped planes, and each of the strip-shaped planes is parallel to a straight line formed by arrangement of the plurality of light source portions; the extension surface of each of the extension portions and the light adjusting surface of each of the light adjusting portions form step surfaces, and the light emitted from the light source portions directly illuminates the light adjusting surfaces of the light adjusting portions and then is reflected out directionally.

Alternatively, the number of the light source portions is plural, and the plurality of light source portions is arranged in a linear single row or a plurality of rows; the extension surface of each of the extension portions of the light-emitting structure and the light adjusting surface of each of the light adjusting portions are strip-shaped planes, and each of the strip-shaped planes is parallel to a straight line formed by arrangement of the plurality of light source portions; the extension surface of each of the extension portions and the light adjusting surface of each of the light adjusting portions form step surfaces; each of the extension portions and each of the light adjusting portions are made of a transparent optical material; and the light emitted from the light source portions is transmitted through the transparent optical material and then illuminates the light adjusting surfaces of the light adjusting portions and then directionally and totally reflected.

Alternatively, the number of the light source portions is plural, and the plurality of light source portions is arranged in a linear single row or a plurality of rows; the extension surface of each of the extension portions of the light-emitting structure and the light adjusting surface of each of the light adjusting portions are strip-shaped planes, and each of the strip-shaped planes is parallel to a straight line formed by arrangement of the plurality of light source portions; the extension surface of each of the extension portions and with the light adjusting surface of each of the light adjusting portions form step surfaces; each of the extension portions and each of the light adjusting portions are made of a transparent optical material; and the light emitted from the light source portions is transmitted through the transparent optical material and then is refracted out by the light adjusting surfaces of the light adjusting portions.

Alternatively, the transparent optical material has a light incident surface disposed opposite to the light adjusting surface; or the transparent optical material has a plurality of light incident surfaces which sequentially form a step shape.

Alternatively, each of the extension portions and each of the light adjusting portions are concentrically disposed with a center point being the circle center, and the extension surface of each of the extension portions and the light adjusting surface of each of the light adjusting portions form step surfaces; the plurality of light source portions is circumferentially arranged with the center point being the circle center, and the plurality of light source portions is disposed around the light-emitting structure.

Alternatively, each of the extension portions and each of the light adjusting portions are concentrically disposed with a center point being the circle center, and the extension surface of each of the extension portions and the light adjusting surface of each of the light adjusting portions form step surfaces; the plurality of light source portions is circumferentially arranged with the center point being the circle center, and the light-emitting structure is disposed around the light source portions.

In the present application, by improving a constitution structure between the extension portions and the light adjusting portions, the light-emitting range of the light-emitting structure is controlled by using the extension portions, so that the size of the light-emitting aperture of the light-emitting structure can be designed according to the needs of the actual illumination range; by designing the angular relationship between the light adjusting portions and the extension portions, the light-emitting direction is controlled, and directional light emission is carried out according to an illumination direction, thereby solving the problem that in the prior art, it is difficult to flexibly design and apply the relationship between the ranges of the light-emitting apertures of the reflection cup and the TIR lens and the directional light emission as required.

Figure 1:
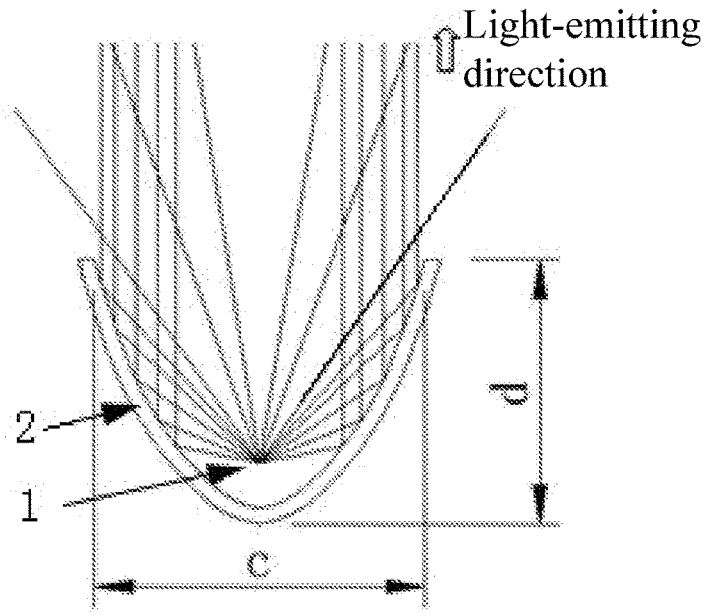
FIG. 1 is a schematic view of an optical path of a light-emitting system in the prior art.

extension portions 10, light adjusting portions 20, light incident surfaces 30, light source portions 100, a light-emitting source 101, a reflection cup 102, a first reflective mirror 103, and a second reflective mirror 104 are provided.

DETAILED DESCRIPTION

To make the objectives, technical solutions, and advantages of the present application clearer and more comprehensible, the following further describes the present application in detail with reference to the accompanying drawings and embodiments. It should be understood that the specific embodiments described herein are merely used to explain the present application and are not intended to limit the present application.

It should be noted that when an element is referred to as being "fixed" or "disposed" on another element, it may be directly or indirectly positioned on the another element. When an element is referred to as being "connected" to another element, it may be connected directly or indirectly to another element.

It should also be noted that the orientation terms such as left, right, up and down in this embodiment are merely mutually relative concepts or take a normal use state of a product as reference, and should not be considered as restrictive.

Figure 2:
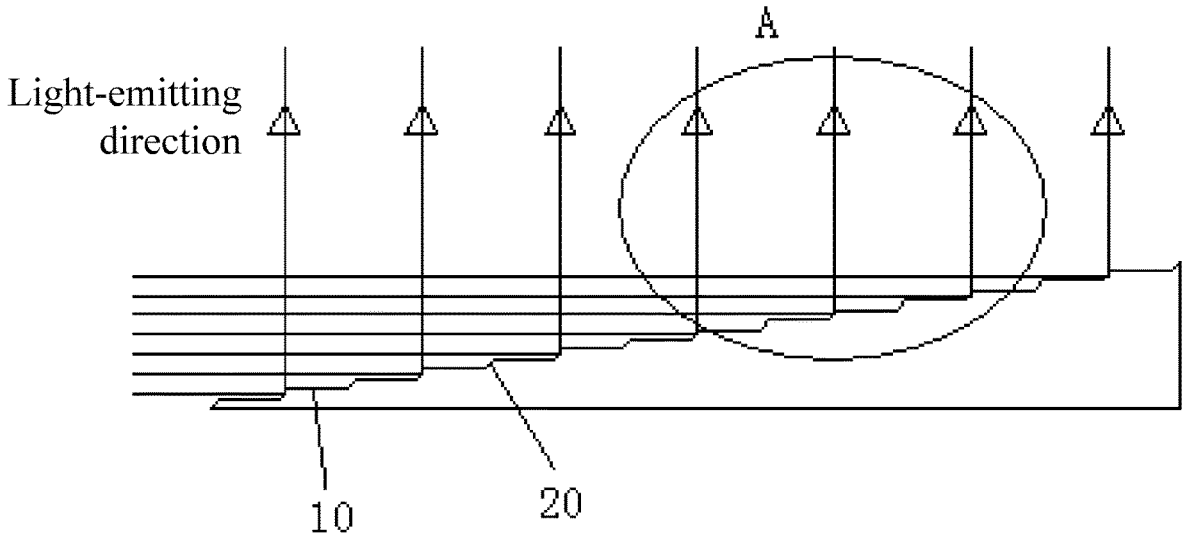
FIG. 2 is a schematic view of an optical path of a light-emitting structure according to a first embodiment of the present application.

As shown in FIG. 2 to FIG. 6, schematic structural views of light-emitting structures according to various embodiments of the present application are shown. As shown in FIG. 2, in the light-emitting structure according to a first embodiment of the present application, the light-emitting structure includes a plurality of extension portions 10 and a plurality of light adjusting portions 20, and the plurality of extension portions 10 and the plurality of light adjusting portions 20 are configured to be sequentially alternately connected; the plurality of extension portions 10 controls the size of the light-emitting range of the light-emitting structure, and the plurality of light adjusting portions 20 is disposed at a predetermined angle with respect to an incident light direction to control a light-emitting direction.

By improving a constitution structure between the extension portions 10 and the light adjusting portions 20, the light-emitting range of the light-emitting structure is controlled by using the extension portions 10, so that the size of the light-emitting aperture of the light-emitting structure can be designed according to the requirement of the actual illumination range; by designing the angular relationship between the light adjusting portions 20 and the extension portions 10, the light-emitting direction is controlled, and directional light emission is carried out according to requirements of an illumination direction, thereby solving the problem that in the prior art, it is difficult to flexibly design and apply the relationship between the ranges of the light-emitting apertures of the reflection cup and the TIR lens and the directional light emission as required.

In the present application, the light-emitting structure is formed by the plurality of extension portions 10 and the plurality of light adjusting portions 20 disposed on a light-emitting structure body; certainly, the light-emitting structure may also be formed by stitching and combination of a plurality of separate extension portions 10 and a plurality of separate light adjusting portions 20. Further, the light adjusting portion 20 is mainly configured to, through light guide surfaces thereon, perform directional processing on incident light and then output the incident light (the incident light illuminates the light guide surfaces of the light adjusting portions 20).

Figure 3:
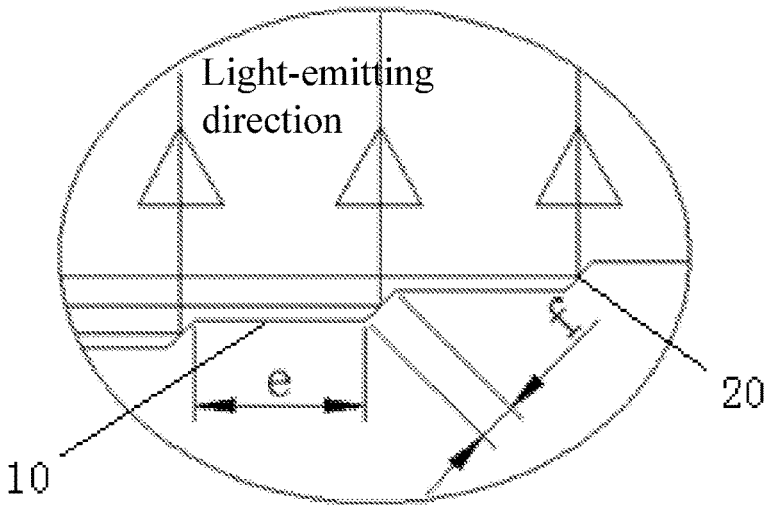
FIG. 3 is a schematic enlarged view of an optical path at A of FIG. 2.

In the light-emitting structure of the first embodiment, as shown in FIG. 3, in a horizontal extending direction, the extension surfaces of the respective extension portions 10 are planes which are parallel and spaced apart from each other; the width of each of the extension portions 10 in the horizontal direction is e, and the tilting width of light adjusting the surface of each of the light adjusting portions 20 is f; and each of the extension portions 10 is disposed at a first predetermined angle with the light adjusting surface of the adjacent light adjusting portion 20 (the size of the first predetermined angle is not shown in FIG. 3, and at this time the thickness of the light-emitting structure along the expanding direction gradually increases). In the light-emitting structure, the incident light is incident in parallel to the extension surfaces of the extension portions 10. When the parallel light is incident on the light adjusting surfaces of the light adjusting portions 20, after being reflected by the light adjusting surfaces, the light is directionally emitted in the direction perpendicular to the extension surfaces of the extension portions 10, such as in the light-emitting direction as shown in FIG. 2 and FIG. 3. Certainly, adjusting the incident angle of the incident light can correspondingly adjust the light-emitting direction of the directional light emission; alternatively, the incident angle of the incident light is kept unchanged and the incident light is still incident parallel to the extension surfaces of the extension portions 10, and then a first predetermined angle between the light adjusting surfaces of the light adjusting portions 20 and the extension surfaces is adjusted and designed, so that the light-emitting direction is changed to achieve directional light emission.

Figure 4A:
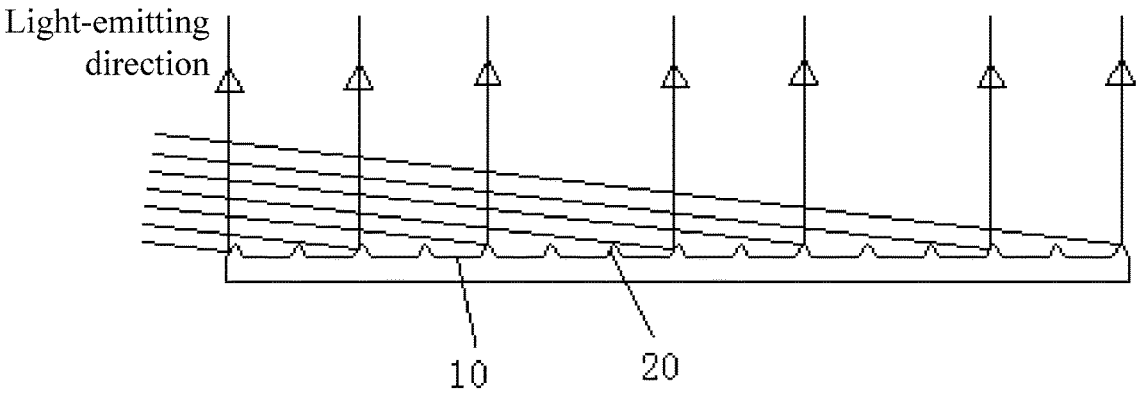
FIG. 4*a* is a schematic view of a first optical path of a light-emitting structure according to a second embodiment of the present application.
Figure 4B:
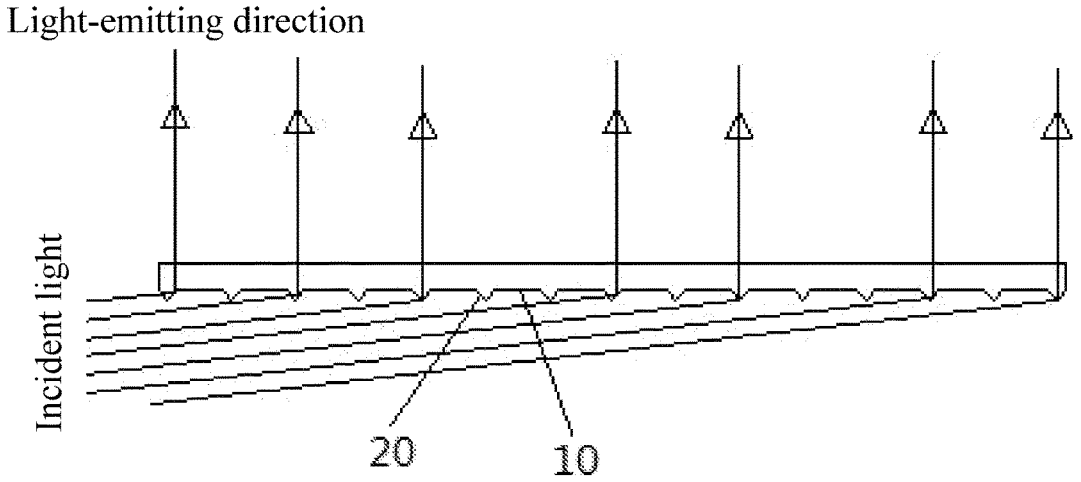
FIG. 4*b* is a schematic view of a second optical path of a light-emitting structure according to a second embodiment of the present application.

As shown in FIG. 4*a* and FIG. 4*b*, in a light-emitting structure of a second embodiment of the present application, in a horizontal extending direction, the extension surfaces of the respective extension portions 10 are parallel planes, and the extension surfaces of the respective extension portions 10 extend in the same horizontal plane; that is, a thickness of the light-emitting structure of the second embodiment is kept unchanged in the extension direction; each of the light adjusting portions 20 protrudes from the horizontal plane, and the extension surface of each of the extension portions 10 is disposed at a second predetermined angle with the light adjusting surface of the adjacent light adjusting portion 20 (the size of the second predetermined angle is not shown in FIG. 4*a*). In the second embodiment, the cross section of each light adjusting portion 20 is triangular. At this time, both inclined planes of the light adjusting portion 20 can be used as light adjusting surfaces. Certainly, the cross section of the light adjusting portion 20 may also be trapezoidal. When the light adjusting portion 20 with a cross section being in a right trapezoid shape is utilized, the inclined planes can be used as the light adjusting surfaces, and when the light adjusting portion 20 having a cross section in an isosceles trapezoid shape is utilized, the inclined planes on both sides can be used as the light adjusting surfaces. In the second embodiment, in order to obtain the light-emitting direction perpendicular to the extension surfaces of the extension portions 10, the incident direction of incident light is incident at an angle with the horizontal plane, and when the incident angle between the incident light and the horizontal plane is changed, the light-emitting direction also changes accordingly. As shown in FIG. 4*a*, in a first optical path of the second embodiment, each light adjusting portion 20 of the light-emitting structure is a specular reflection plane (at this time a light-emitting structure body may be made of any material, transparent or opaque, plastic or metal and the like); the incident light illuminates the light adjusting portion 20 obliquely with respect to the horizontal plane, and then the incident light is directionally reflected and output by the light adjusting portion 20, thereby causing the incident light to directionally illuminate a position required to be illuminated. As shown in FIG. 4*b*, in a second optical path of the second embodiment, the light-emitting structure is made of a transparent light-transmissive material, and at this time light is refracted on the light adjusting portion 20 (the incident light illuminates a light-receiving surface of the light adjusting portion 20 obliquely to the horizontal plane); the light is totally reflected and adjusted by another surface (this surface is opposite to the light-receiving surface) of the light adjusting portion 20, the adjusted light is directionally transmitted through the light-emitting structure body for directional output, and then illuminates a position required to be illuminated. The second embodiment is identical to the first embodiment in structure except that the above structure is different.

Figure 5:
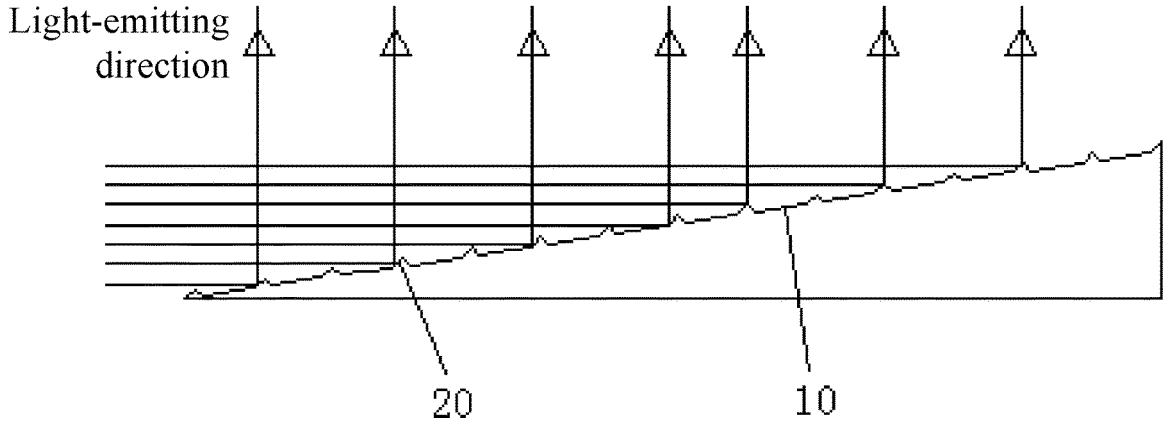
FIG. 5 is a schematic view of an optical path of a light-emitting structure according to a third embodiment of the present application.

As shown in FIG. 5, in a light-emitting structure according to a third embodiment of the present application, the extension surfaces of the extension portions 10 extend in the same reference plane, and the reference plane is arranged to be at an angle with the horizontal plane, that is, the reference plane is an inclined plane; each of the light adjusting portions 20 protrudes from the reference plane, and the light adjusting surface of each of the light adjusting portions 20 is disposed at a third predetermined angle with the horizontal plane (the size of the third predetermined angle is not shown in FIG. 5). In the third embodiment, the cross section of each light adjusting portion 20 is triangular. At this time, both inclined planes of the light adjusting portion 20 can be used as light adjusting surfaces. Certainly, the cross section of the light adjusting portion 20 may also be trapezoidal. When the light adjusting portion 20 with a cross section being in a right trapezoid shape is utilized, the inclined planes can be used as the light adjusting surfaces, and when the light adjusting portion 20 with a cross section of an isosceles trapezoid shape is utilized, the inclined planes on both sides can be used as the light adjusting surfaces. In the third embodiment, the incident light is incident parallel to the horizontal plane and then reflected by the light adjusting surface of the light adjusting portion 20, and then the outgoing light is emitted perpendicular to the horizontal plane. When the incident angle of the incident light is changed, for example, when the incident light is obliquely incident downwards, the outgoing light is inclined towards the incident light, so that the light-emitting direction of the directional light emission is changed; and for another example, when the incident light is obliquely incident upwards, the outgoing light is inclined away from the incident light, thereby changing the light-emitting direction of the directional light emission. The third embodiment is identical to the first embodiment in structure except that the above structure is different.

Figure 6:
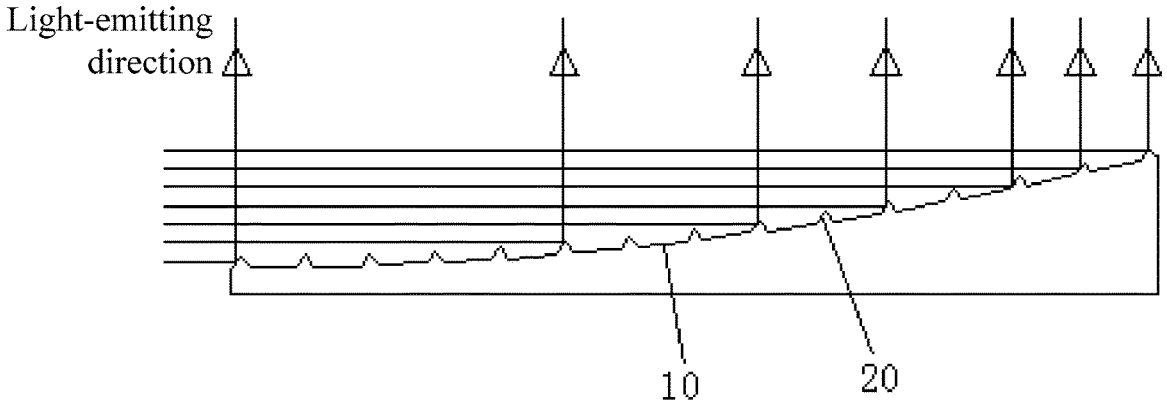
FIG. 6 is a schematic view of an optical path of a light-emitting structure according to a fourth embodiment of the present application.

As shown in FIG. 6, in a light-emitting structure according to a fourth embodiment of the present application, an extension surface of each extension portion 10 is a curved surface, and the extension surface of each curved surface and the light adjusting surface of each light adjusting portion 20 are sequentially alternately disposed; preferably, a parabolic curve is formed if the extension surfaces of the curved surfaces are connected with each other, and the light adjusting surface of each light adjusting portion 20 is disposed at a fourth predetermined angle with the horizontal plane (the size of the fourth predetermined angle is not shown in FIG. 6). In the fourth embodiment, the cross section of each light adjusting portion 20 is triangular. At this time, both inclined planes of the light adjusting portion 20 can be used as light adjusting surfaces. Certainly, the cross section of the light adjusting portion 20 may also be trapezoidal. When the light adjusting portion 20 with a cross section being in a right trapezoid shape is utilized, the inclined planes can be used as the light adjusting surfaces, and when the light adjusting portion 20 with a cross section of an isosceles trapezoid shape is utilized, the inclined planes on both sides can be used as the light adjusting surfaces. In the fourth embodiment, the incident light is incident parallel to the horizontal plane and then reflected by the light adjusting surface of the light adjusting portion 20, and then outgoing light is emitted perpendicular to the horizontal plane. When the incident angle of the incident light is changed, for example, when the incident light is obliquely incident downwards, the outgoing light is inclined towards the incident light, so that the light-emitting direction of the directional light emission is changed; and for another example, when the incident light is obliquely incident upwards, the outgoing light is inclined away from the incident light, thereby changing the light-emitting direction of the directional light emission. The fourth embodiment is identical to the first embodiment in structure except that the above structure is different.

The present application also provides a light-emitting structure according to a fifth embodiment (not shown). An extension surface of each extension portion 10 is a plane; the extension surfaces of the respective extension portions 10 are sequentially disposed at gradually increased angles with the horizontal plane; that is, a parabolic curve is formed when the respective extension surfaces are infinitely small and connected to each other; each light adjusting portion 20 protrudes from the adjacent extension surface, and a light adjusting surface of each light adjusting portion 20 is disposed at a fifth predetermined angle with the horizontal plane. The fifth embodiment is identical to the first embodiment except that the above structure is different.

Figure 7:
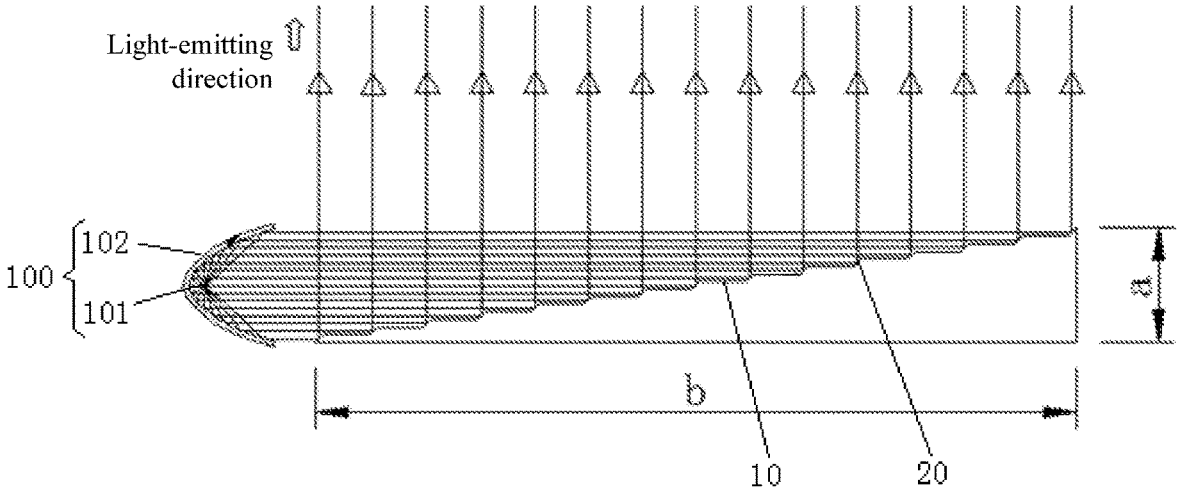
FIG. 7 is a schematic view of an optical path of a light-emitting system according to a first embodiment of the present application.

According to another aspect of the present application, as shown in FIG. 7, a light-emitting system such as a first embodiment is provided, including a light source portion 100 and a light-emitting structure, where the light source portion 100 includes a light-emitting source 101; the light-emitting structure is the above-mentioned light-emitting structure, and light emitted by the light-emitting source 101 is directionally guided out by the light-emitting structure. Further, in the first embodiment, the light source portion 100 further includes a reflection cup 102. The light-emitting source 101 is disposed in a notch of the reflection cup 102, and the reflecting surface of the reflection cup 102 reflects and converges the light emitted from the light-emitting source 101 and then emits the light, and the emitted light illuminates the light adjusting surface of the light adjusting portion 20 of the light-emitting structure for directional light emission. As shown in FIG. 7, the light-emitting source 101 is mounted in a concave chamber of a concave surface of the reflection cup 102, and then scattered light emitted from the light-emitting source 101 is converged into directional light by the reflecting surface of the reflection cup 102 for emission, so that the diameter length of the range of the light finally output by the light source portion 100 is a (provided that the reflection cup 102 has a circular opening), parallel light is incident parallel to the extension surface of the extension portion 10 on the light adjusting surface of the light adjusting portion 20 and is reflected, so that the maximum width of the illumination range of the light finally illuminating a target needing illumination is b through the extension portion 10 (the value range of b can be arbitrarily determined according to actual needs).

Figure 8:
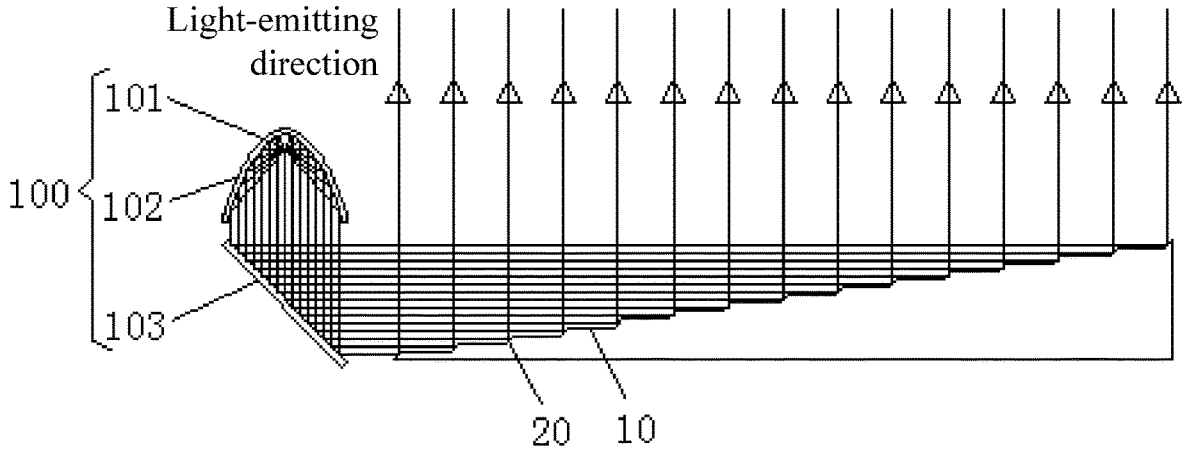
FIG. 8 is a schematic view of an optical path of a light-emitting system according to a second embodiment of the present application.

As shown in FIG. 8, the light source portion 100 of the light-emitting system according to the second embodiment of the present application further includes a first reflective mirror 103, and the first reflective mirror 103 is configured to reflect parallel light reflected by the reflecting surface of the reflection cup 102; the reflective mirror surface of the first reflective mirror 103 is disposed opposite to the reflecting surface of the reflection cup 102, and then the first reflective mirror 103 directly reflects the light to the light adjusting surface of the light adjusting portion 20 for adjustment of the light-emitting direction, and the reflective mirror surface of the first reflective mirror 103 reflects the light emitted by the reflecting surface to the light adjusting surface of the light adjusting portion 20. When the first reflective mirror 103 is at 45° angle with respect to the horizontal plane, the reflection cup 102 vertically emits light onto the first reflective mirror 103, and then the light is horizontally reflects by the first reflective mirror 103 to the light adjusting surface of the light adjusting portion 20 of the light-emitting structure. In the second embodiment, as shown in FIG. 8, the reflection cup 102 is disposed above the first reflective mirror 103. When it is necessary to adjust the light-emitting direction of the directional illumination, only the placement angle and the placement position of the first reflective mirror 103 need to be adjusted. While the range of the directional illumination is expanded in a larger range by effectively utilizing directional light, the influence on the concentrated illumination effect of the directional illumination caused by the situation that scattered light emitted from the light-emitting source 101 directly illuminates the light-emitting structure is reduced using the first reflective mirror 103.

Figure 9:
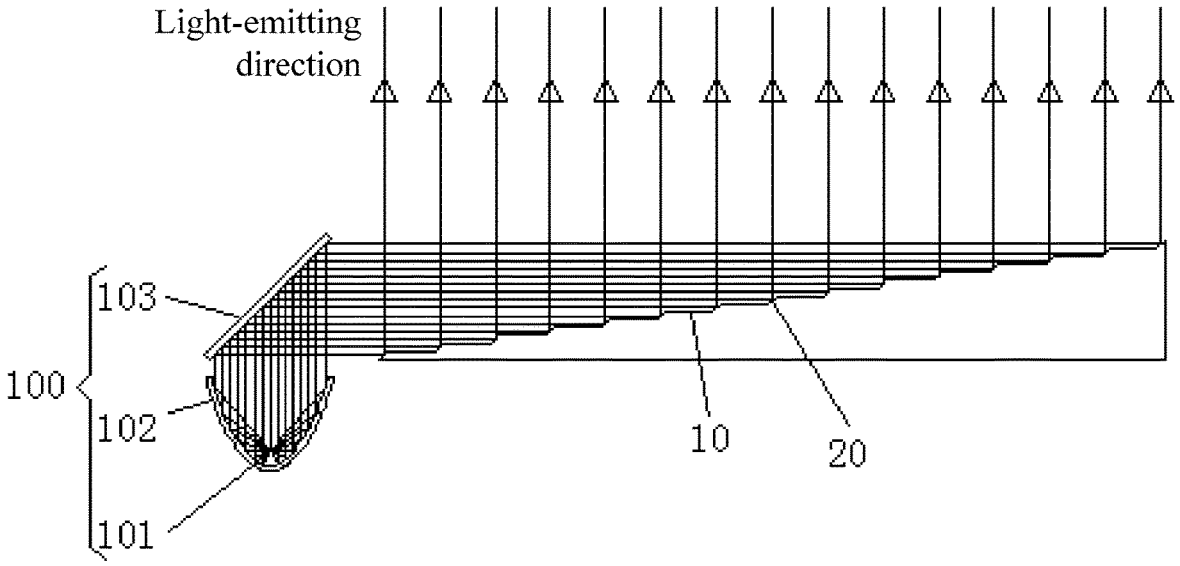
FIG. 9 is a schematic view of an optical path of a light-emitting system according to a third embodiment of the present application.

As shown in FIG. 9, compared with the light-emitting system according to the second embodiment, the light-emitting system according to the third embodiment of the present application has the reflection cup 102 disposed below the first reflective mirror 103. The third embodiment is identical to the second embodiment in structure except that the above structure is different.

Figure 10:
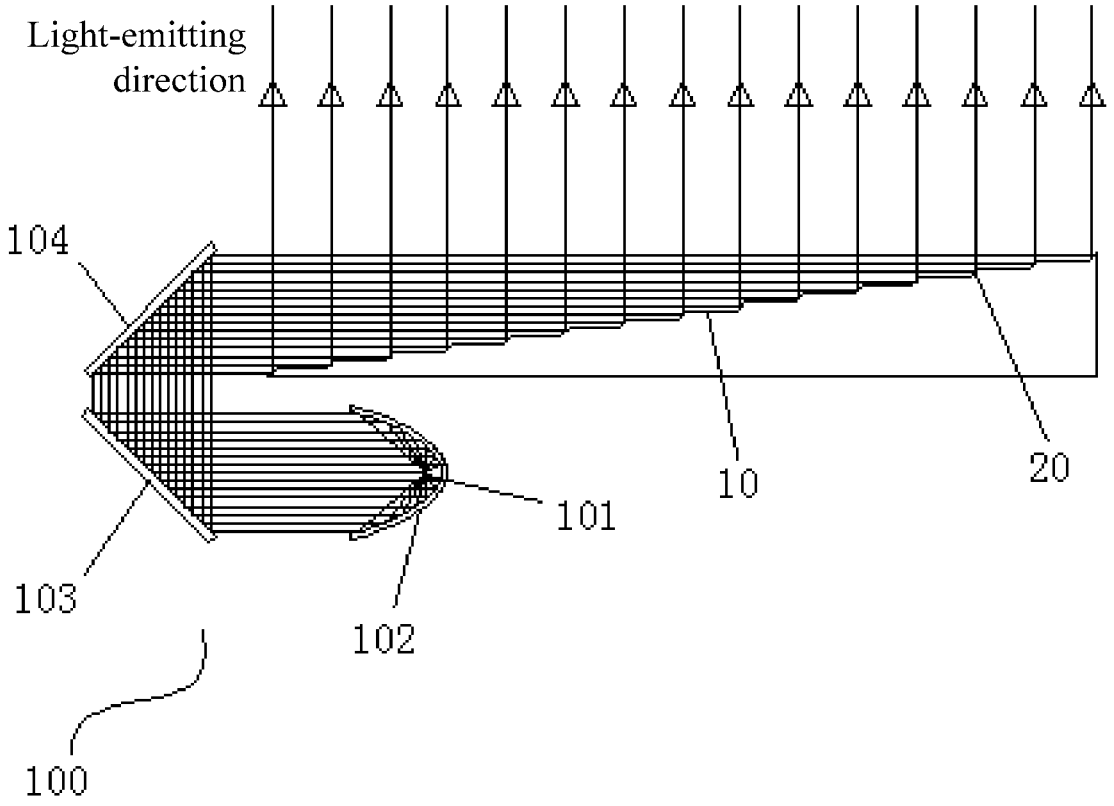
FIG. 10 is a schematic view of an optical path of a light-emitting system according to a fourth embodiment of the present application.

As shown in FIG. 10, compared with the second embodiment, in the light-emitting system according to the fourth embodiment of the present application, the light source portion 100 also includes a second reflective mirror 104; a reflective mirror surface of the second reflective mirror 104 is disposed opposite to the reflective mirror surface of the first reflective mirror 103; and the reflective mirror surface of the second reflective mirror 104 reflects the light reflected by the first reflective mirror 103 to light adjusting surfaces of the light adjusting portions 20. In the fourth embodiment, after being reflected twice by the first reflective mirror 103 and the second reflective mirror 104, the light is reflected to the light adjusting surfaces of the light adjusting portions 20 to be directionally reflected for directional illumination. Since the second mirror 104 is added, and the light-emitting structure also moves up a little corresponding to the placement height of the second reflective mirror 104, the reflection cup 102 can be disposed directly below the light-emitting structure. While the range of the directional illumination is expanded in a larger range by effectively utilizing directional light, the influence on the concentrated illumination effect of the directional illumination caused by the situation that scattered light emitted by the light-emitting source 101 directly illuminates the light-emitting structure is eliminated thoroughly using the first reflective mirror 103 and the second reflective mirror 104.

The light-emitting systems of the first embodiment to the fourth embodiment are each provided with only one light source portion.

Figure 11A:
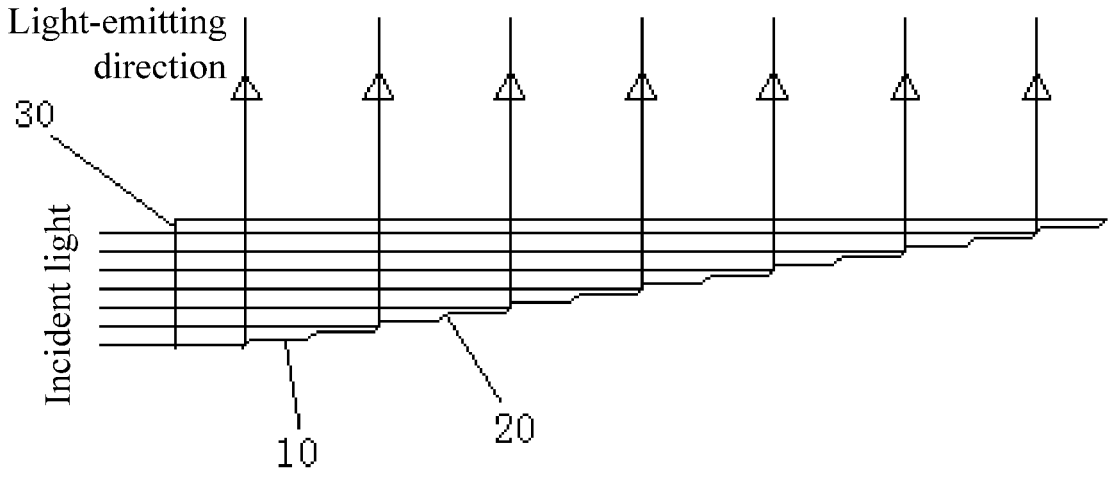
FIG. 11*a* is a schematic view of an optical path of a light-emitting system with a light incident surface according to a fifth embodiment of the present application.

As shown in FIG. 11*a*, in the light-emitting system according to the fifth embodiment of the present application, the light-emitting structure in this embodiment is made of a transparent optical material. Compared with the fourth embodiment, in the fifth embodiment, incident light enters the transparent optical material and then reaches the light adjusting surfaces of the light adjusting portions 20, and the light is subjected to total reflection at the light adjusting surfaces by applying the principle of total reflection, thereby emitting the light directionally. Further, the transparent optical material has a light incident surface disposed opposite to the light adjusting surface; or the transparent optical material has a plurality of light incident surfaces which sequentially form a step shape, and the plurality of light incident surfaces is disposed opposite to the light adjusting surface. The fifth embodiment is identical to the fourth embodiment except that the above structure is different.

Figure 12:
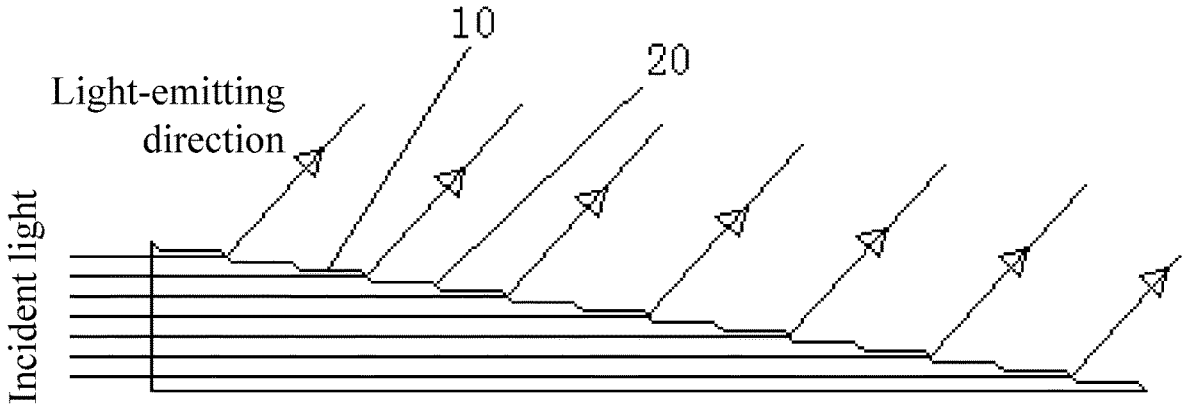
FIG. 12 is a schematic view of an optical path of a light-emitting system according to a sixth embodiment of the present application.

As shown in FIG. 12, compared with the fifth embodiment, in the light-emitting system according to a sixth embodiment of the present application, the light-emitting structure in this embodiment is also made of a transparent optical material. Moreover, incident light enters the transparent optical material and then reaches the light adjusting surfaces of the light adjusting portions 20, and the light is refracted at the boundary of the optical material by applying the principle of refraction, thereby emitting the light directionally. This embodiment is identical to the fifth embodiment except that the above structure is different.

Figure 11B:
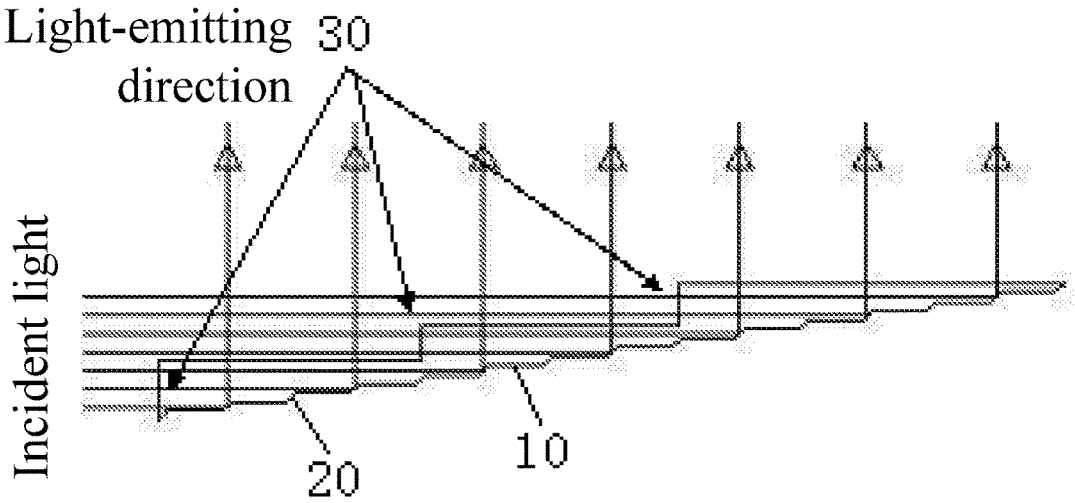
FIG. 11*b* is a schematic view of an optical path of a light-emitting system with a plurality of light incident surfaces according to a fifth embodiment of the present application.
Figure 13:
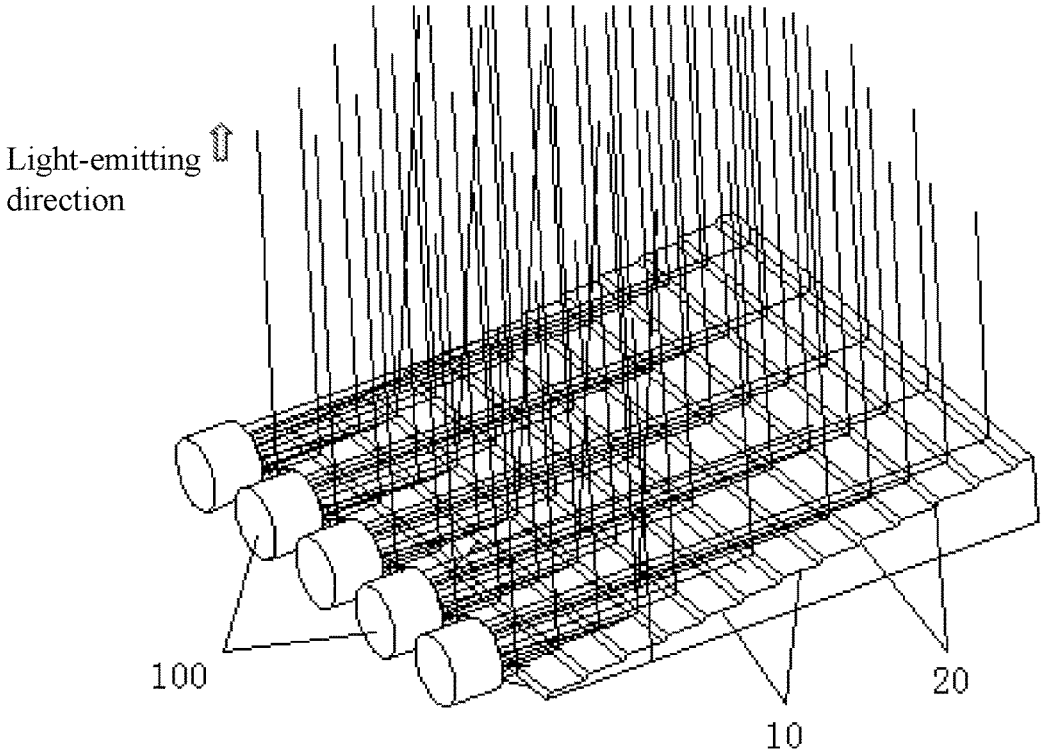
FIG. 13 is a schematic view of an optical path of a light-emitting system according to a seventh embodiment of the present application.

As shown in FIG. 13, in a light-emitting system according to a seventh embodiment of the present application, the number of the light source portions 100 is plural, and the plurality of light source portions 100 is arranged in a linear single row or a plurality of rows; the extension surface of each extension portion 10 of the light-emitting structure and the light adjusting surface of each light adjusting portion 20 are strip-shaped planes, and each of the strip-shaped planes is parallel to a straight line formed by disposing the plurality of light source portions 100; the extension surface of each of the extension portions 10 forms a step surface with the light adjusting surface of each of the light adjusting portions 20, and the light emitted by the light source portions 100 directly illuminates the light adjusting surfaces of the light adjusting portions 20 and then is reflected out directionally. Referring to the light-emitting system according to the fourth embodiment of the present application, the influence on the concentrated illumination effect of the directional illumination caused by the situation that scattered light emitted by the plurality of light source portions 100 directly illuminates the light adjusting surfaces of the light adjusting portions 20 of the light-emitting structure is eliminated using the first reflective mirror 103 and the second reflective mirror 104. Similarly, the light-emitting system according to the seventh embodiment can also guide the directional light-emitting direction of the light by utilizing the principle of total reflection or the principle of refraction. In the seventh embodiment, a plurality of light source portions 100 uses a reflection cup 102 to converge the light. In the seventh embodiment, as shown in FIG. 11*b*, the light incident surface is the same as the light incident surface disposed in the fifth embodiment; the transparent optical material has a light incident surface disposed opposite to the light adjusting surface; or the transparent optical material has a plurality of light incident surfaces which sequentially form a step shape, and the plurality of light incident surfaces is disposed opposite to the light adjusting surfaces. The incident light illuminates the transparent optical material from the light incident surface, and then is propagated to the light adjusting surfaces through the transparent optical material as a light propagation medium, and the light is emitted after the light-emitting direction is adjusted at the light adjusting surfaces, thereby obtaining light of directional illumination at a required angle.

Compared with the seventh embodiment, in another feasible embodiment, the number of the light source portions 100 is plural, and the plurality of light source portions 100 is arranged in a linear single row or a plurality of rows; the extension surface of each extension portion 10 of the light-emitting structure and the light adjusting surface of each light adjusting portion 20 are strip-shaped planes, and each of the strip-shaped planes is parallel to a straight line formed by disposing the plurality of light source portions 100; the extension surface of each of the extension portions 10 forms a step surface with the light adjusting surface of each of the light adjusting portions 20; each of the extension portions 10 and each of the light adjusting portions 20 are made of a transparent optical material; and light emitted by the light source portions 100 passes through the transparent optical material and then illuminates the light adjusting surfaces of the light adjusting portions 20 for directional total reflection. In this embodiment, the principle of total reflection is applied to perform directional light emission, and the rest of the structure and principle are the same as those in the seventh embodiment.

Compared with the seventh embodiment, in a further feasible embodiment, the number of the light source portions 100 is plural, and the plurality of light source portions 100 is arranged in a linear single row or a plurality of rows; the extension surface of each extension portion 10 of the light-emitting structure and the light adjusting surface of each light adjusting portion 20 are strip-shaped planes, and each of the strip-shaped planes is parallel to a straight line formed by disposing the plurality of light source portions 100; the extension surface of each of the extension portions 10 forms a step surface with the light adjusting surface of each of the light adjusting portions 20; each of the extension portions 10 and each of the light adjusting portions 20 are made of a transparent optical material; and light emitted by the light source portions 100 passes through the transparent optical material and then is refracted out through the light adjusting surfaces of the light adjusting portions 20. In this embodiment, the principle of refraction is applied to perform directional light emission, and the rest of the structure and principle are the same as those in the seventh embodiment.

Figure 14:
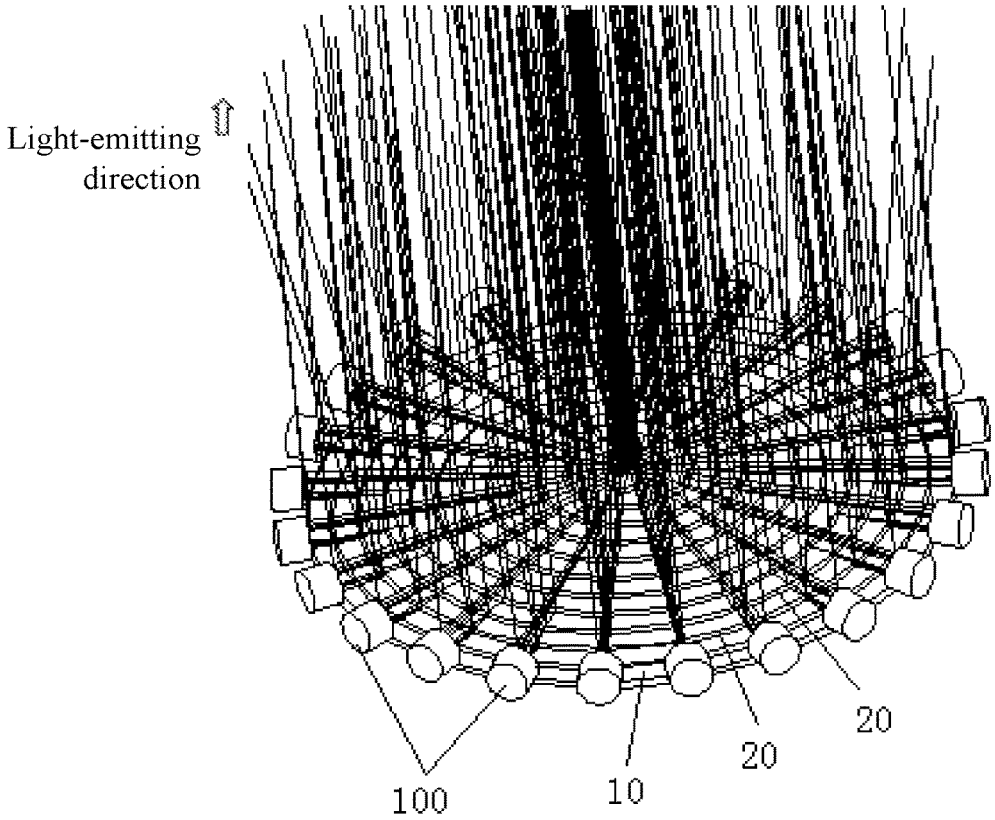
FIG. 14 is a schematic view of an optical path of a light-emitting system according to an eighth embodiment of the present application.

As shown in FIG. 14, in a light-emitting system according to an eighth embodiment of the present application, each extension portion 10 and each light adjusting portion 20 are concentrically disposed with a center point (not shown in FIG. 14) as a circle center, and the extension surface of each of the extension portions 10 forms a step surface with the light adjusting surface of each of the light adjusting portions 20; the plurality of light source portions 100 is circumferentially arranged with the center point as the circle center, and the plurality of light source portions 100 is disposed around the light-emitting structure. Referring to the light-emitting system according to the fourth embodiment of the present application, the influence on the concentrated illumination effect of the directional illumination caused by the situation that scattered light emitted by the plurality of light source portions 100 directly illuminates the light adjusting surfaces of the light adjusting portions 20 of the light-emitting structure is eliminated using the first reflective mirror 103 and the second reflective mirror 104. Similarly, the light-emitting system according to the eighth embodiment can also guide the directional light-emitting direction of the light by utilizing the principle of total reflection or the principle of refraction. In the eighth embodiment, a plurality of light source portions 100 uses a reflection cup 102 to condense the light.

Figure 15:
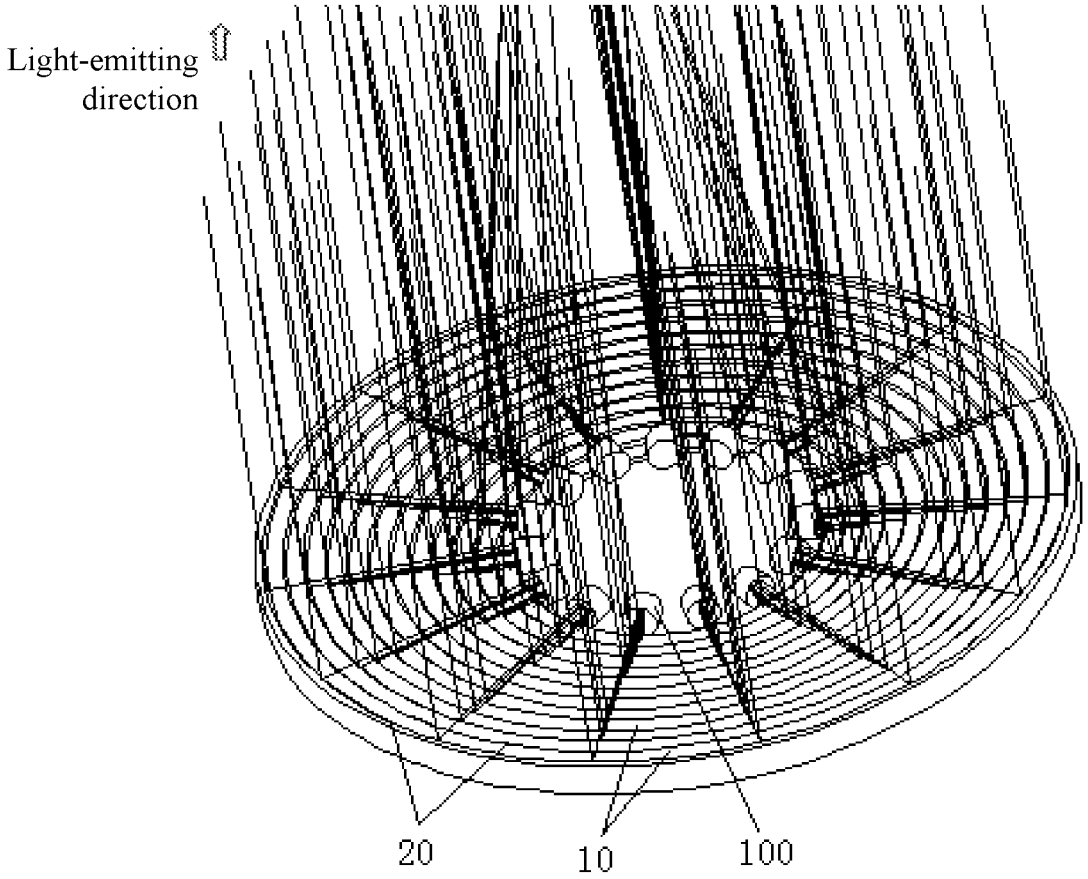
FIG. 15 is a schematic view of an optical path of a light-emitting system according to a ninth embodiment of the present application.

As shown in FIG. 15, in a light-emitting system according to a ninth embodiment of the present application, each extension portion 10 and each light adjusting portion 20 are concentrically disposed with a center point (not shown in FIG. 15) as a circle center, and the extension surface of each of the extension portions 10 forms a step surface with the light adjusting surface of each of the light adjusting portions 20; the plurality of light source portions 100 is circumferentially arranged with the center point as the circle center, and the light-emitting structure is disposed around the light source portions 100. The rest of the structure and principle are the same as those in the eighth embodiment. In the ninth embodiment, a plurality of light source portions 100 uses a reflection cup 102 to condense the light.

Besides utilizing the reflection cup 102 to converge light, the light-emitting system in the corresponding embodiment of the present application may also apply one selected from a group consisting of a total reflection lens, a refractive lens, a Fresnel lens, a convex lens, a TIR lens, and the like to converge the light of the light-emitting source 101 that emits scattered light; that is, the light is converged through the lenses with a light converging function. In addition, the light-emitting sources of the light-emitting systems in all embodiments of the present application may also directly use light emitted by themselves as a light source for converging light, such as one of light-converging sources including a laser light source, a LED laser light source, an optical fiber source, a spotlight light source, a PAR light source, and an AR light source.

The above are only the preferred embodiments of the present application, and are not intended to limit the present application. Any modifications, equivalent substitutions and improvements made within the spirit and principles of the present application should be included in the scope of protection of the present application.

What is claimed is:

1. A light-emitting structure, comprising a plurality of extension portions and a plurality of light adjusting portions, wherein the plurality of extension portions and the plurality of light adjusting portions are sequentially alternately connected; the plurality of extension portions controls the light-emitting range of the light-emitting structure, and the plurality of light adjusting portions is disposed at a predetermined angle with respect to an incident light direction to control a light-emitting direction, wherein in a horizontal extending direction, the extension surfaces of the respective extension portions are parallel planes, and the extension surfaces of the respective extension portions extend in the same horizontal plane; each of the light adjusting portions protrudes from the horizontal plane, and the extension surface of each of the extension portions is disposed at a second predetermined angle with a light adjusting surface of the adjacent light adjusting portion.

2. The light-emitting structure according to claim 1, wherein in a horizontal extending direction, extension surfaces of the respective extension portions are planes which are parallel and spaced apart from each other, and the extension surface of each of the extension portions is disposed at a first predetermined angle with a light adjusting surface of the adjacent light adjusting portion.

3. The light-emitting structure according to claim 1, wherein the extension surfaces of the respective extension portions extend in the same reference plane, and the reference plane is arranged at an angle with the horizontal plane; each of the light adjusting portions protrudes from the reference plane, and the light adjusting surface of each of the light adjusting portions is disposed at a third predetermined angle with the horizontal plane.

4. The light-emitting structure according to claim 1, wherein the extension surface of each of the extension portions is a curved surface; each of the light adjusting portion protrudes from the adjacent extension surface, and the light adjusting surface of the each of the light adjusting portions is disposed at a fourth predetermined angle with the horizontal plane.

5. The light-emitting structure according to claim 1, wherein the extension surface of each of the extension portions is a plane; the extension surfaces of the adjacent extension portions are disposed at gradually increased angles with the horizontal plane; each of the light adjusting portions protrudes from the adjacent extension surface, and the light adjusting surface of each of the light adjusting portions is disposed at a fifth predetermined angle with the horizontal plane.

6. A light-emitting system, comprising a light source portion and a light-emitting structure, wherein the light source portion comprises a light-emitting source, wherein the light-emitting structure is the light-emitting structure according to claim 1, and the light emitted from the light-emitting source is directionally output by the light-emitting structure.

7. The light-emitting system according to claim 6, wherein the light-emitting source is one of directional light sources of a laser light source, a LED laser light source, an optical fiber source, a spotlight light source, a parabolic aluminum reflector (PAR) light source, and an AR light source.

8. The light-emitting system according to claim 6, wherein the light source portion also comprises a reflection cup, and the light-emitting source is disposed inside a notch of the reflection cup; a reflecting surface of the reflection cup reflects and converges light emitted from the light-emitting source and then emits the light, and the emitted light illuminates light adjusting surfaces of the light adjusting portions of the light-emitting structure for directional light output.

9. The light-emitting system according to claim 8, wherein the reflection cup is one of a light-converging TIR lens, a convex lens or a Fresnel lens which has a light converging function.

10. The light-emitting system according to claim 8, wherein the light source portion also comprises a first reflective mirror; a reflective mirror surface of the first reflective mirror is disposed opposite to the reflecting surface of the reflection cup;

and the reflective mirror surface of the first reflective mirror reflects light emitted from the reflecting surface to light adjusting surfaces of the light adjusting portions.

11. The light-emitting system according to claim 10, wherein the light source portion also comprises a second reflective mirror; a reflective mirror surface of the second reflective mirror is disposed opposite to the reflective mirror surface of the first reflective mirror; and the reflective mirror surface of the second reflective mirror reflects light reflected from the first reflective mirror to light adjusting surfaces of the light adjusting portions.

12. The light-emitting system according to claim 8, wherein the number of the light source portions is plural, and the plurality of light source portions is arranged in a linear single row or a plurality of rows; the extension surface of each of the extension portions of the light-emitting structure and the light adjusting surface of each of the light adjusting portions are strip-shaped planes, and each of the strip-shaped planes is parallel to a straight line formed by arrangement of the plurality of light source portions; the extension surface of each of the extension portions and the light adjusting surface of each of the light adjusting portions form a step surface, and the light emitted from the light source portions directly illuminates the light adjusting surfaces of the light adjusting portions and then is reflected out directionally.

13. The light-emitting system according to claim 11, wherein the number of the light source portions is plural, and the plurality of light source portions is arranged in a linear single row or a plurality of rows; an extension surface of each of the extension portions of the light-emitting structure and a light adjusting surface of each of the light adjusting portions are strip-shaped planes, and each of the strip-shaped planes is parallel to a straight line formed by arrangement of the plurality of light source portions; the extension surface of each of the extension portions and the light adjusting surface of each of the light adjusting portions form a step surface; each of the extension portions and each of the light adjusting portions are made of a transparent optical material; and light emitted from the light source portions is transmitted through the transparent optical material and then illuminates the light adjusting surfaces of the light adjusting portions for directional total reflection.

14. The light-emitting system according to claim 11, wherein the number of the light source portions is plural, and the plurality of light source portions is arranged in a linear single row or a plurality of rows; an extension surface of each of the extension portions of the light-emitting structure and a light adjusting surface of each of the light adjusting portions are strip-shaped planes, and each of the strip-shaped planes is parallel to a straight line formed by arrangement of the plurality of light source portions; the extension surface of each of the extension portions and the light adjusting surface of each of the light adjusting portions form a step surface; each of the extension portions and each of the light adjusting portions are made of a transparent optical material; and the light emitted from the light source portions is transmitted through the transparent optical material and then is refracted by the light adjusting surfaces of the light adjusting portions.

15. The light-emitting system according to claim 13, wherein the transparent optical material has a light incident surface disposed opposite to the light adjusting surface; or the transparent optical material has a plurality of light incident surfaces which sequentially form a step shape.

16. The light-emitting system according to claim 8, wherein each of the extension portions and each of the light adjusting portions are concentrically disposed with a center point being a circle center, and the extension surface of each of the extension portions and the light adjusting surface of each of the light adjusting portions form a step surface; the plurality of light source portions is circumferentially arranged with the center point being the circle center, and the plurality of light source portions is disposed around the light-emitting structure.

17. The light-emitting system according to claim 8, wherein each of the extension portions and each of the light adjusting portions are concentrically disposed with a center point being the circle center, and the extension surface of each of the extension portions and the light adjusting surface of each of the light adjusting portions form a step surface; the plurality of light source portions is circumferentially arranged with the center point being the circle center, and the light-emitting structure is disposed around the light source portions.

18. The light-emitting system according to claim 14, wherein the transparent optical material has a light incident surface disposed opposite to the light adjusting surface; or the transparent optical material has a plurality of light incident surfaces which sequentially form a step shape.

* * * * *